US006705577B1

(12) United States Patent
Grimes

(10) Patent No.: US 6,705,577 B1
(45) Date of Patent: Mar. 16, 2004

(54) RECEPTACLE SUPPORT AND METHOD

(76) Inventor: David E. Grimes, 1330 Cherokee Lake Rd., Jesup, GA (US) 31545

( * ) Notice: Subject to any disclaimer, the term of this patent is extended or adjusted under 35 U.S.C. 154(b) by 172 days.

(21) Appl. No.: 09/682,237

(22) Filed: Aug. 8, 2001

(51) Int. Cl.[7] ..... A47G 23/02
(52) U.S. Cl. ..... 248/154
(58) Field of Search ..... 248/154, 128, 248/137, 146, 150, 151, 155.1, 155.4, 156, 85, 466; 362/253; 428/343

(56) References Cited

U.S. PATENT DOCUMENTS 1,831,306 A * 3/1931 Kakimoto
3,235,119 A * 2/1966 Smith ..... 220/475
3,306,486 A * 2/1967 Martino et al. ..... 220/254.3
3,679,161 A * 7/1972 Husting ..... 248/154
3,822,845 A * 7/1974 Kennedy et al. ..... 248/147
4,113,214 A * 9/1978 Dubois ..... 248/146
4,174,085 A * 11/1979 Ferreira et al. ..... 248/97
4,184,659 A * 1/1980 Abrahamson ..... 248/146
4,623,111 A * 11/1986 Prader ..... 248/97
4,666,054 A * 5/1987 Jaicks ..... 220/288
4,711,367 A * 12/1987 Albertson ..... 229/117.12
4,741,494 A * 5/1988 Voornas ..... 248/154
4,927,104 A * 5/1990 Miller ..... 248/97
4,930,653 A * 6/1990 Machado ..... 220/23.4
D327,756 S * 7/1992 Klein et al. ..... D34/1
5,139,299 A * 8/1992 Smith ..... 294/159
5,360,189 A * 11/1994 Hart ..... 248/97
5,570,862 A * 11/1996 Nugent ..... 248/97
5,758,888 A * 6/1998 Burgan et al. ..... 280/47.34
5,887,834 A * 3/1999 Gellos et al. ..... 248/156
6,260,507 B1 * 7/2001 Simpson et al. ..... 116/200
6,488,253 B1 * 12/2002 Piccolomini ..... 248/505

* cited by examiner

*Primary Examiner*—Korie Chan
*Assistant Examiner*—A. Joseph Wujciak
(74) *Attorney, Agent, or Firm*—Mark Young

(57) ABSTRACT

A device for keeping trash receptacles from being knocked or blown over comprises a rigid vertical rod assembly to which a trash receptacle is gravitationally engaged, and a spike assembly frictionally secured to the ground. The device may comprise one unit or two separable mating parts.

6 Claims, 16 Drawing Sheets

RECEPTACLE SUPPORT AND METHOD

BACKGROUND OF INVENTION

This invention is a novel portable rigid support device and method for keeping portable receptacles, e.g., trash containers, upright. Particularly with regard to trash containers, the problem of dogs and other animals pushing them over and spreading the trash around is well known. This is unsightly, presents a health hazard, and is a nuisance to clean up.

In recent years, many localities have mandated the use of high-capacity (e.g., 90 gallon) roll-away receptacles that can be dumped by a special truck. These vessels hold more trash and create an even larger mess if knocked over. These larger trash cans usually have a lower aspect ratio (base width to height) than smaller ones, as well as a larger lateral surface area, and can therefore be blown over more easily by wind gusts. There is thus a need for a convenient way to stabilize waste receptacles against side forces.

This invention relates primarily to the field of supports, and more specifically to releasable supports. It also relates to receptacles, more specifically to portable receptacles, and still more specifically to their stability and spill prevention. It relates collaterally therefore to neighborhood aesthetics, environmental protection, and public health. Because of the invention's potential visibility, it also relates to the field of safety and navigational markers and indicia.

SUMMARY OF INVENTION

The first embodiment of the invention is a unitary, shaped rod structure which is secured by hand or foot to the ground in a location where a receptacle is to be temporarily located. When desired, the receptacle then can be fixedly secured to the structure by hand in an upright orientation. A second embodiment of the invention comprises not only a shaped rod structure secured to the ground, but another shaped rod structure secured to the receptacle. The rod structures are designed to engage each other temporarily in a fixed and rigid manner when the receptacle is positioned to maintain the receptacle in an upright orientation.

The object of this invention is to provide a convenient and inexpensive way to secure waste cans against tipping over by anchorage to the ground. It is a further object of the invention to provide these features in a form that is easy to install and easy to relocate. Yet another object of the invention is to accomplish these objects with minimal interference with vehicular traffic such as lawn mowers. An additional object of the invention is to allow it to provide the function of a visual marker (e.g., driveway marker) in combination with the foregoing.

DETAILED DESCRIPTION

Figure 1:
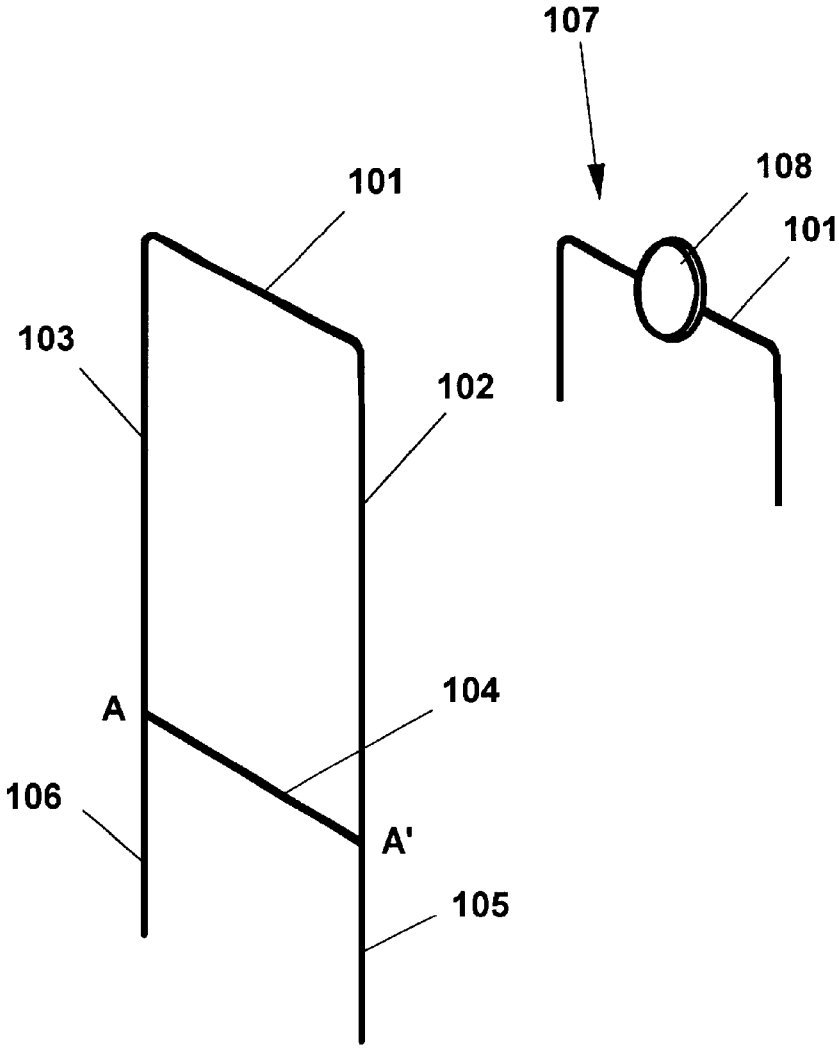
FIG. 1 is a perspective view of the first embodiment of the present invention.

Referring now in greater detail to the drawings, in which like alphanumeric characters correspond to like features in all of the figures, FIG. 1 is a perspective view of the first embodiment of the present invention. It comprises a rod of rigid material formed into three sides of a rectangle having a top 101, a right side 102, and a left side 103. Top 101 serves as a head over which a downward-facing cavity on a receptacle (such as a trash can handle or lift pocket) can be secured. Rigidly attached to sides 102 and 103 at intermediate points A and A' is a rigid elongate stirrup 104. The portion of side 102 extending below the stirrup 104 is a right spike 105 and a left spike 106. Optionally, portions 107 of the top 101 and/or sides 102 and 103 can be made visually more distinctive by coloration, application of reflective coating material, or by application of a reflective device 108, to contrast with the normal outdoor environment. This makes the invention easier to see, thereby reducing the potential for striking the invention with other objects (e.g., vehicles) and permitting it to double as a driveway marker in cases where the trash receptacle is posted for pickup near the end of a driveway.

Figure 2:
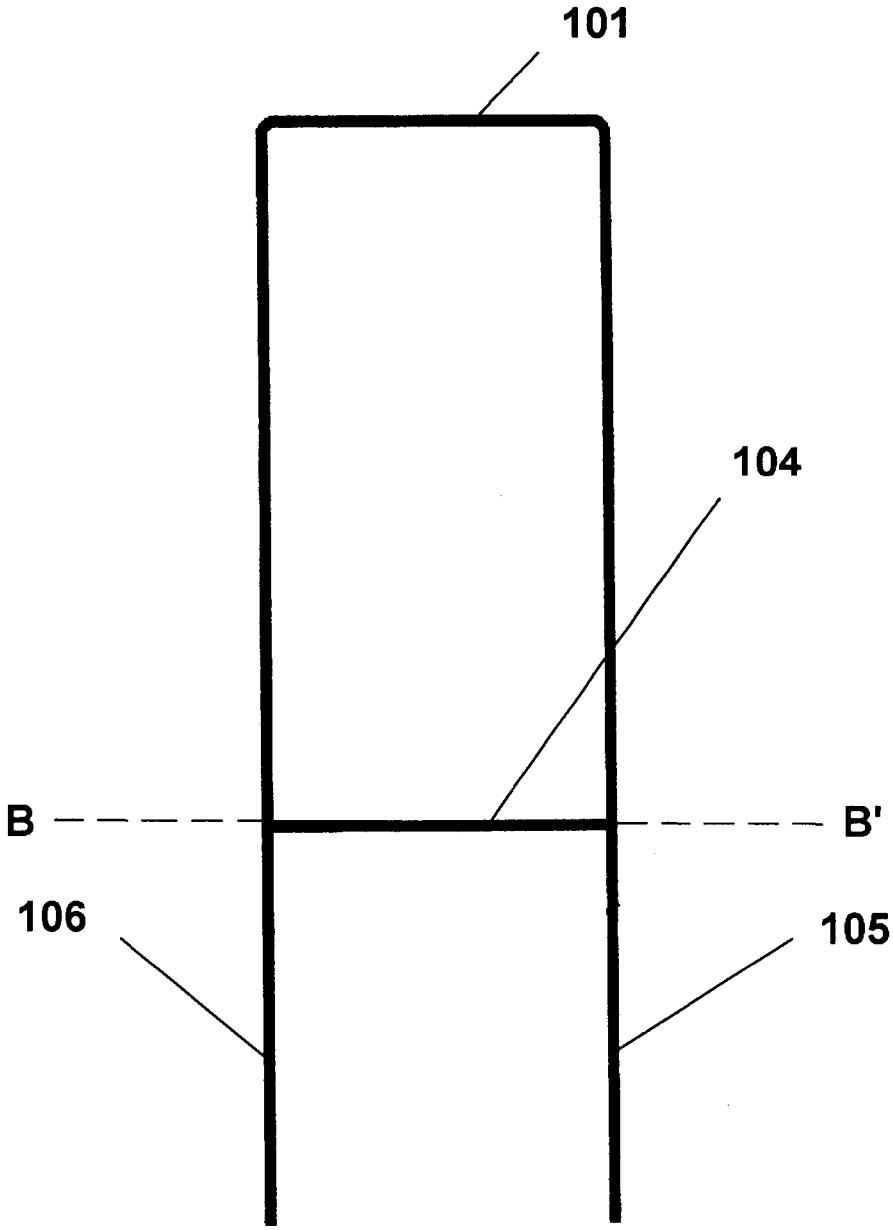
FIG. 2 is a front view of the first embodiment of the present invention.

FIG. 2 is a front view of the first embodiment of the present invention. If a person holds top 101 in hand, places the lower ends of spikes 105 and 106 in contact with the ground, and presses with sufficient force on stirrup 104, spikes 105 and 106 will be forced toward ground level B–B'. Further pressure on stirrup 104 will cause it to descend until it comes substantially into contact with the ground. The invention can be moved to another location by pulling up on top 101 to slide the invention out of the ground.

Figure 3:
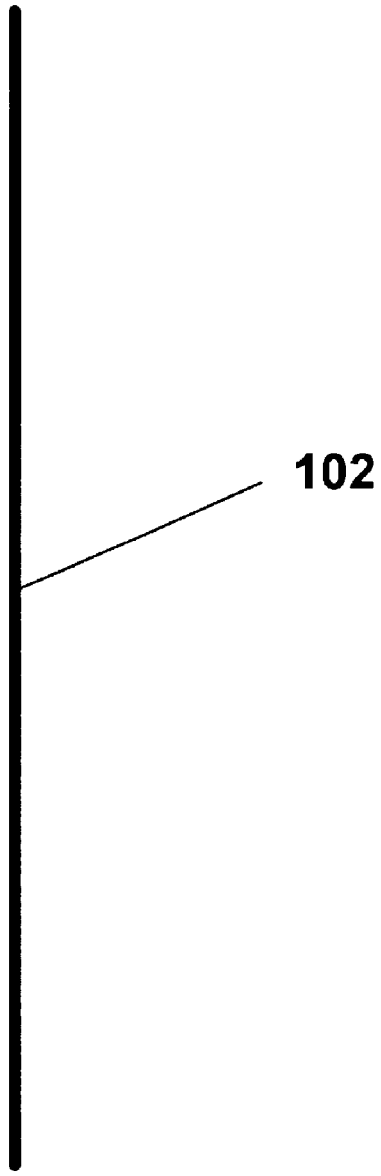
FIG. 3 is a side view of the first embodiment of the present invention.

FIG. 3 is a side view of the first embodiment of the present invention showing that all parts are coplanar. Only right side 102 is visible.

Figure 4:
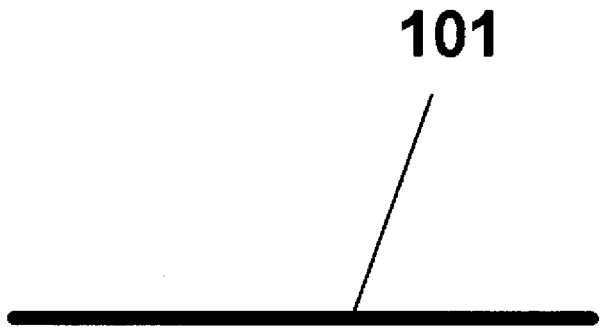
FIG. 4 is a top view of the first embodiment of the present invention.

FIG. 4 is a top view of the first embodiment of the present invention. Only top 101 is visible.

Figure 5:
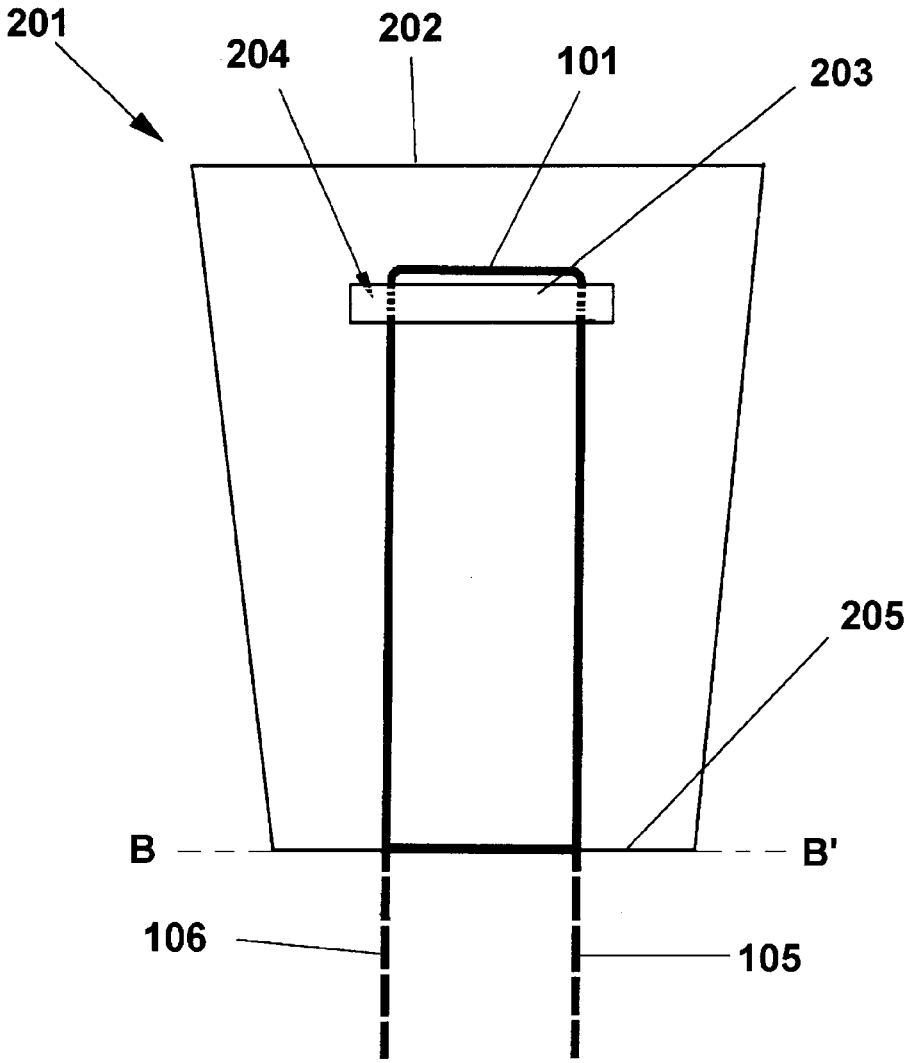
FIG. 5 is a front view of the first embodiment of the present invention with a common trash can installed on it.

FIG. 5 is a front view of the first embodiment of the present invention with a common trash can 201 installed on it. A feature common to most trash cans is the presence of matching handles on either side of it near the top edge 202. Only the front-facing handle 203 is shown. The handles typically have a portion spaced away from the can wall creating a cavity 204. This cavity 204, created on three sides by the handle 203 and the wall of the trash can 201, has a vertical axis, and it is typically open at least on the bottom (the end of the cavity facing the ground) to receive the fingers of the person handling it and may be closed over on top. To assure that the trash can is held in a vertical position, cavity 204 in handle 203 is fitted over top 101 of the invention, and trash can 201 is allowed to slide down until can bottom 205 rests at ground level B–B'. If the cavity 204 is closed on top (not shown) the trash can may hang by top 101.

Figure 6:
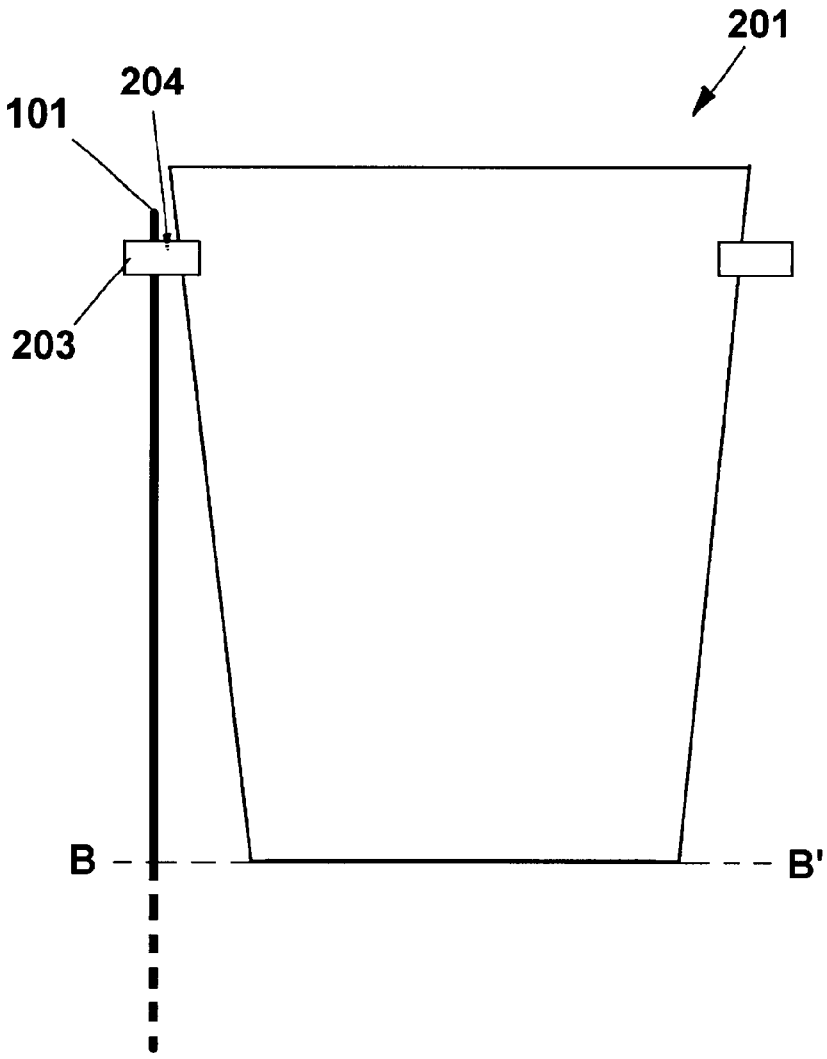
FIG. 6 is a side view of the first embodiment of the present invention with a common trash can installed on it.

FIG. 6 is a side view of the first embodiment of the present invention with a common trash can 201 installed on it.

Figure 7:
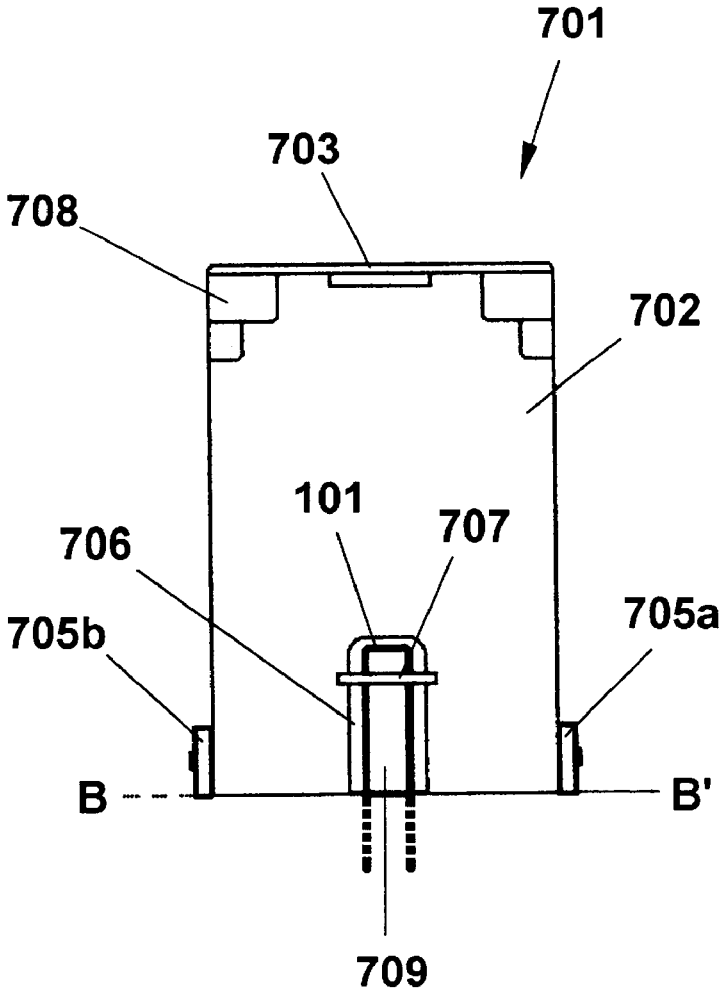
FIG. 7 is a front view of the first embodiment of the present invention with a roll-away trash receptacle installed on it.

FIG. 7 is a front view of the first embodiment of the present invention with a roll-away trash receptacle 701 installed on it. Such receptacles typically comprise a substantially rectangular box 702 with a hinged lid 703, a sealed bottom 704, side stiffeners 708, and two wheels 705*a* and 705*b*. The wheels are typically on adjacent rear bottom corners so that the receptacle can be tilted onto them and rolled to a spot where a garbage truck (not shown) can lift it and dump it. It is desirable, though not necessary, for the garbage truck to lower the receptacle onto the present invention after dumping.

Roll-away receptacles typically further comprise a recess 706 in the lower front with a retainer 707 rigidly attached across the open side of the recess. The recess 706 and retainer 707 define a downward-facing cavity 709. The receptacle 701 can be held in a vertical position by the present invention if the person moving the receptacle places retainer 707 over the top 101 of the invention. This is accomplished by tilting the receptacle back on its wheels and rolling the receptacle up to the invention until the recess comes into contact with sides 102 and 103 of the present invention. The receptacle is then tipped back into a vertical position while allowing the invention to slide upward within the cavity 709. When the invention is used with the roll-away receptacle, sides 102 and 103 on this embodiment will be generally shorter than they will be when used with the trash can of FIG. 6, so that the length of sides 102 and 103 can be provided in two or more lengths to work cooperatively with two or more common types of trash receptacles.

Figure 8:
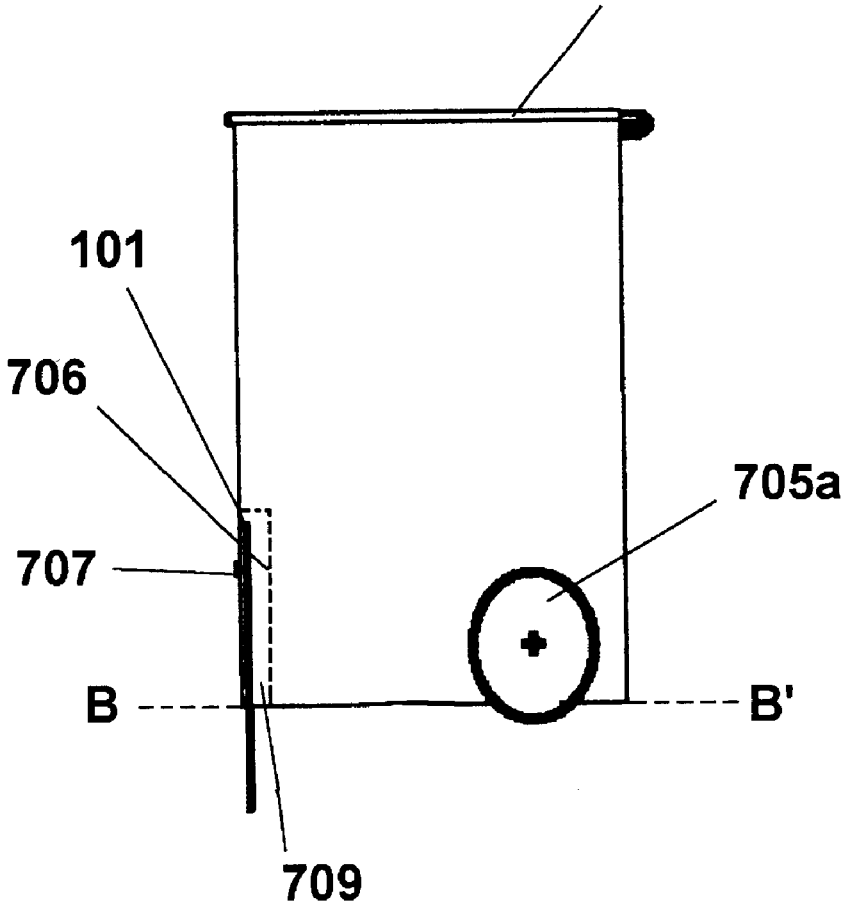
FIG. 8 is a side view of the first embodiment of the present invention with a roll-away trash receptacle installed on it.

FIG. 8 is a right side view of the first embodiment of the present invention with a roll-away trash receptacle installed on it. It more clearly shows cavity 709 formed by recess 706 and retainer 707.

Figure 9:
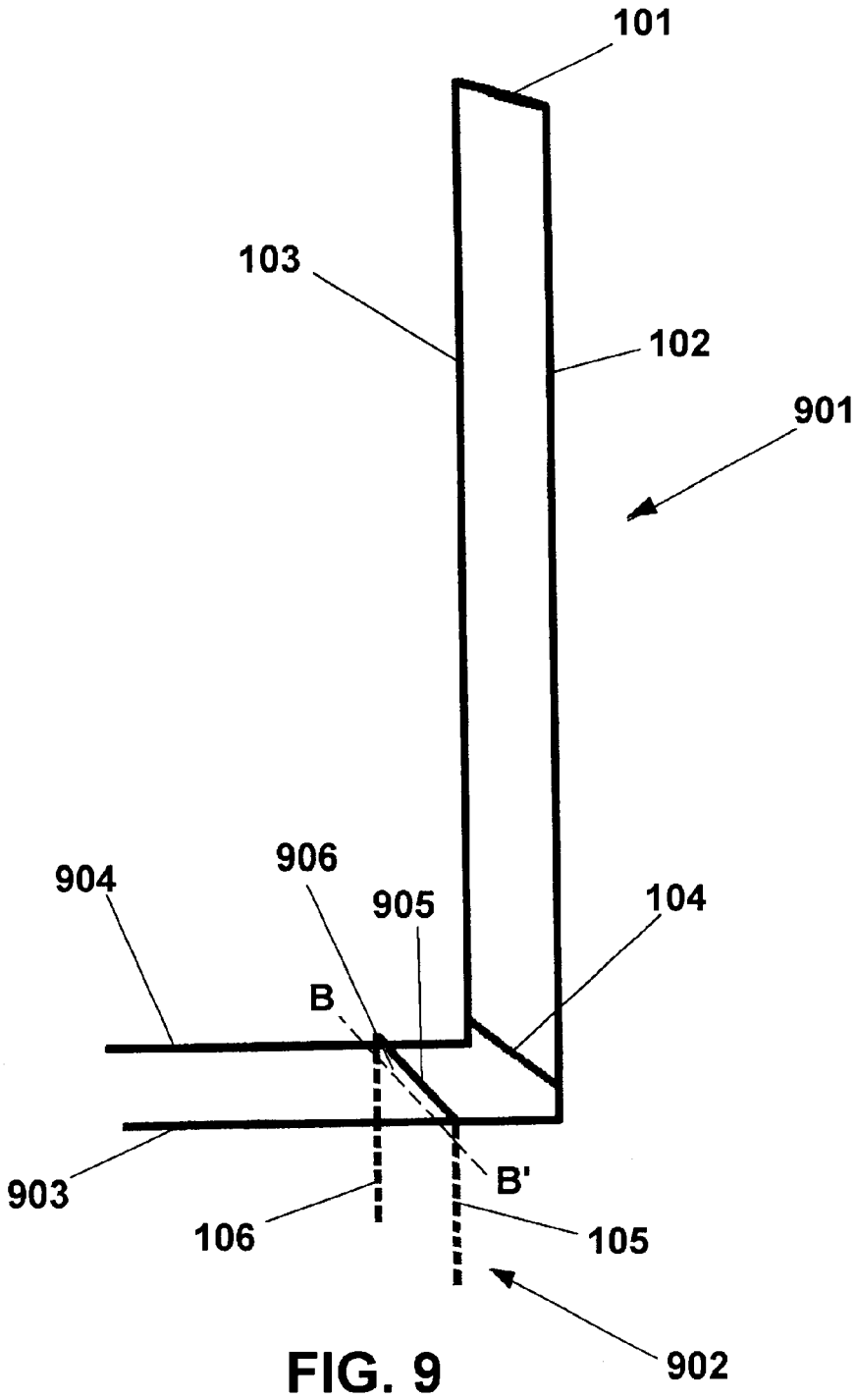
FIG. 9 is a perspective view of the second embodiment of the present invention.

FIG. 9 is a perspective view of a second embodiment of the present invention. It comprises an upper fork portion 901 and a lower spike portion 902. The upper portion comprises a top 101, stirrup 104, and sides 102 and 103 as in the first embodiment, but instead of ground-engaging spikes, it comprises horizontal forks 903 and 904. Stirrup 104 is no longer used to push the device into the ground but instead serves as a stiffener for the upper portion 901. The purpose of the second embodiment is twofold: one, to allow the removal of the visible portion of the apparatus (the upper fork portion 901) for aesthetic purposes and/or so that a vehicle (typically a lawn mower) can be run over the lower spike portion 902 without striking it; and two, to permit the use of one upper fork portion 901 with a plurality of lower spike portions 902 which can be fixed permanently into the ground at a plurality of locations for secure vertical positioning of a receptacle.

The lower spike portion 902 of this embodiment comprises a horizontal cross piece 905 which join vertical ground engaging spikes 105 and 106. The spike portion 902 is pushed into the ground at an appropriate location by foot pressure on cross piece 905 until cross piece 905 is close enough to ground level B–B' so as to provide a narrow space 906 between it and the ground. To assure that the receptacle is held in a vertical position, forks 903 and 904 are slid underneath cross piece 905 which is secured to the ground.

Figure 9A:
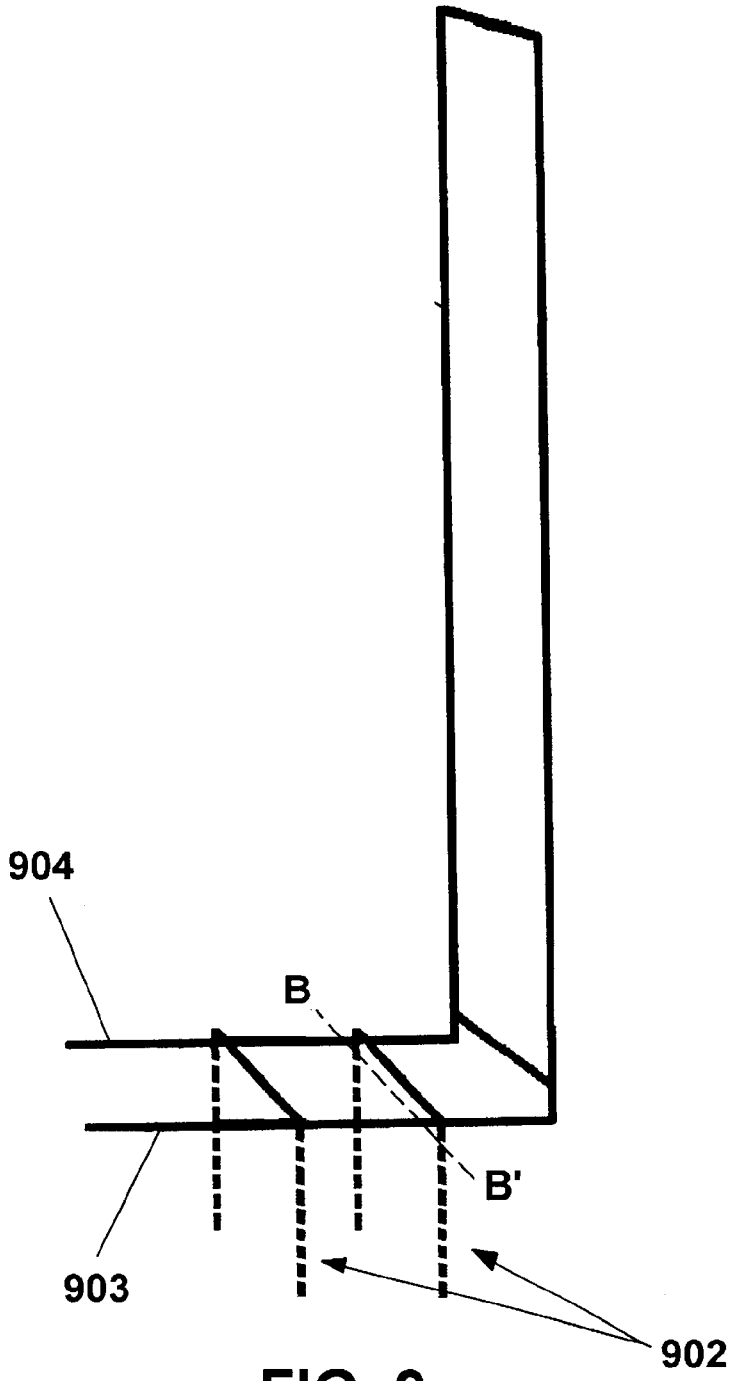
FIG. 9*a* is a perspective view of the second embodiment showing plural spike portions.

FIG. 9*a* shows how a plurality of lower spike portions 902 may be inserted into the ground parallel to one another at two or more places along the forks 903 and 904, if desired to provide additional vertical stability.

Figure 10:
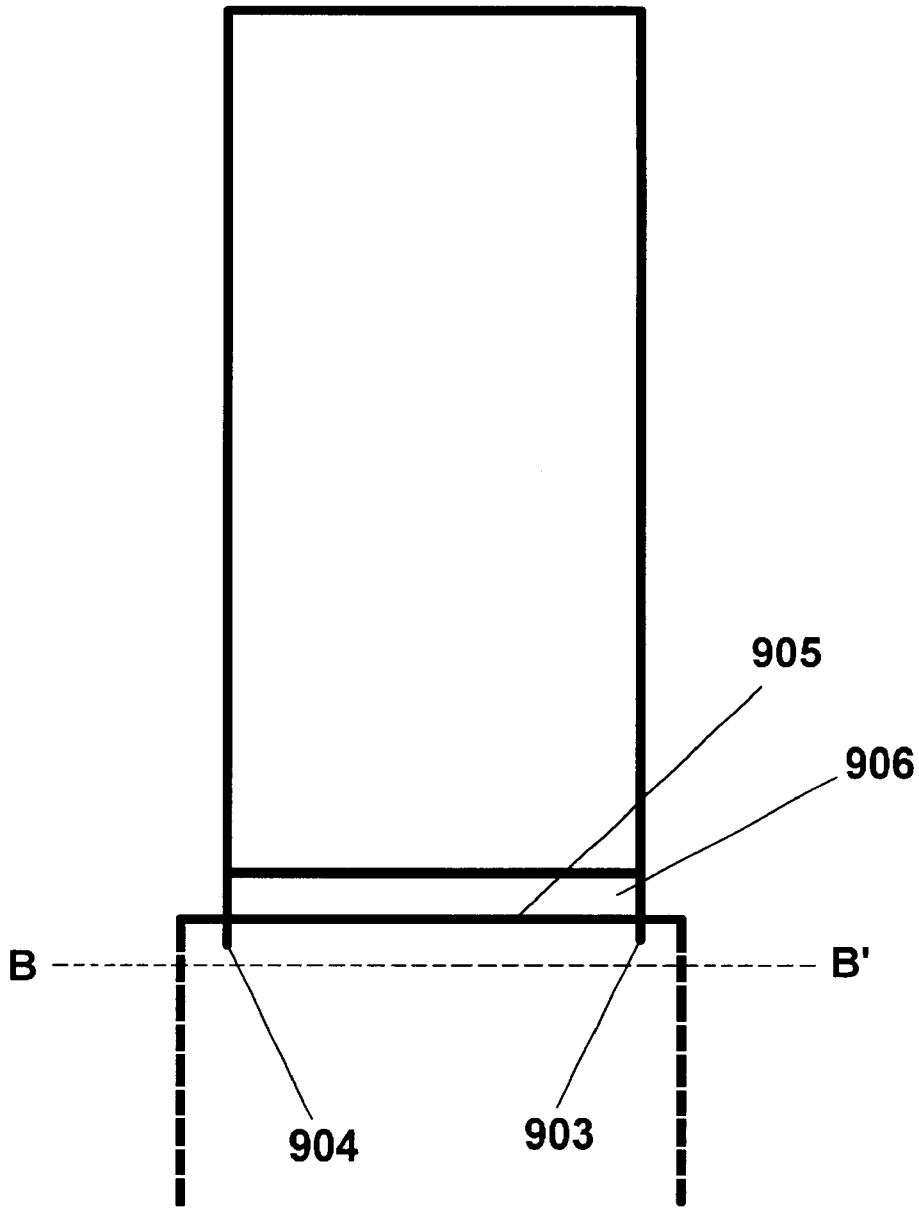
FIG. 10 is a front view of the second embodiment of the present invention.

FIG. 10 is a front view of the second embodiment of the present invention, showing that forks 903 and 904 are positioned below cross piece 905 but on ground level B–B'.

Figure 11:
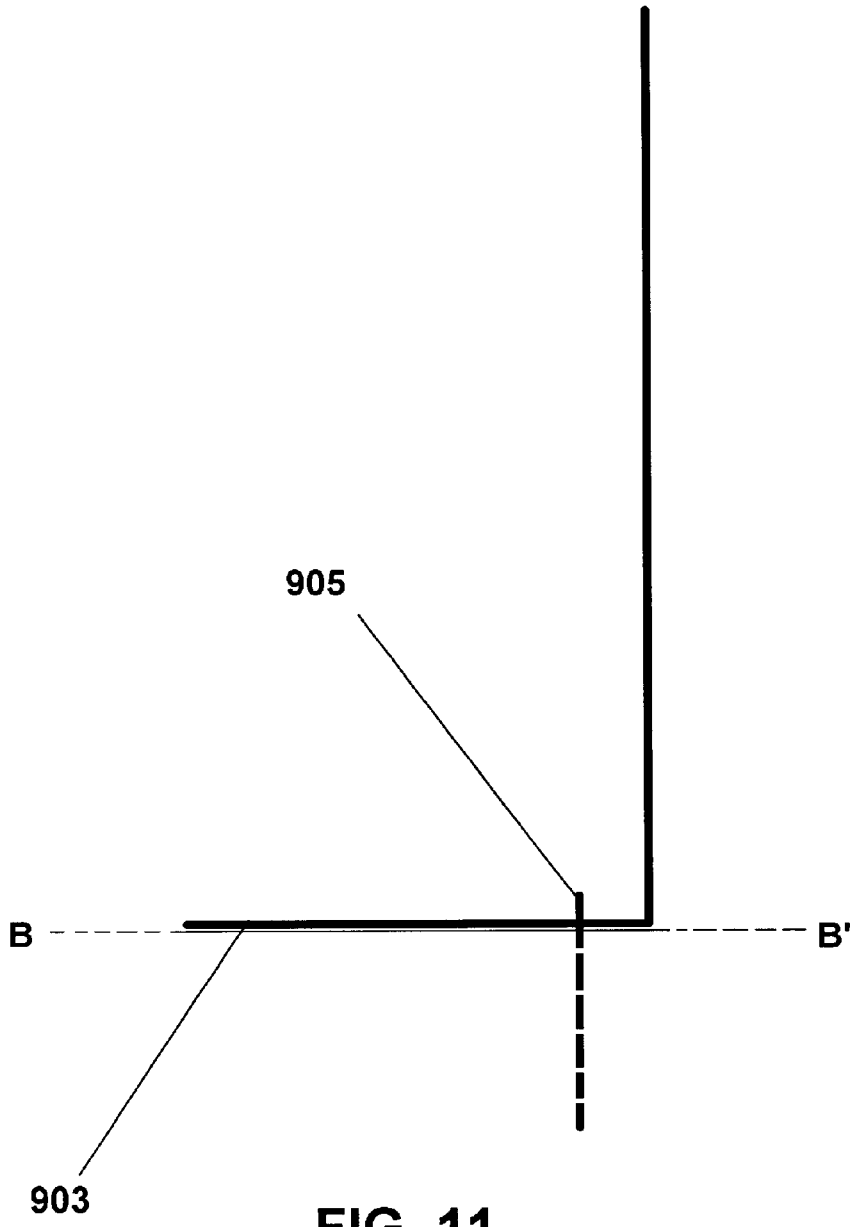
FIG. 11 is a side view of the second embodiment of the present invention.

FIG. 11 is a side view of the second embodiment of the present invention.

Figure 12:
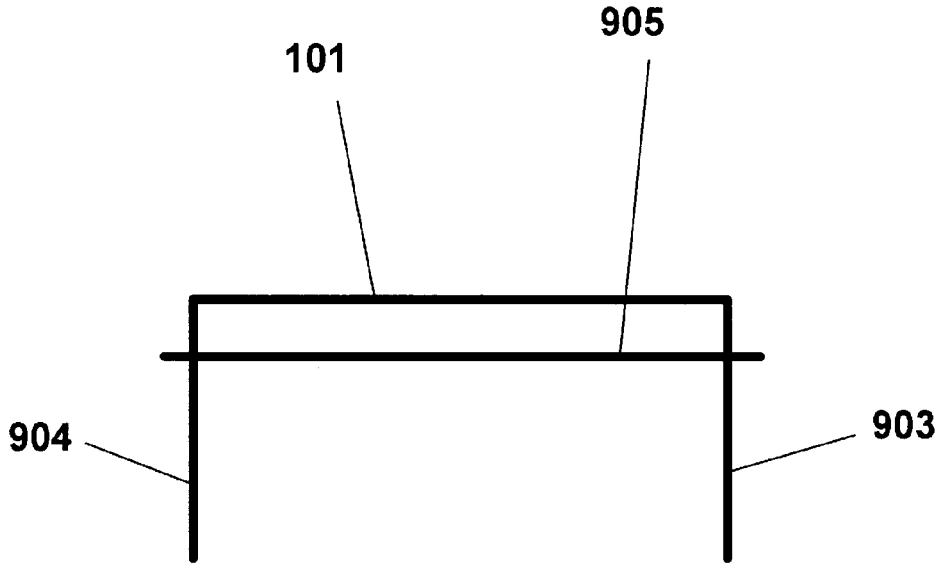
FIG. 12 is a top view of the second embodiment of the present invention.

FIG. 12 is a top view of the second embodiment of the present invention.

Figure 13:
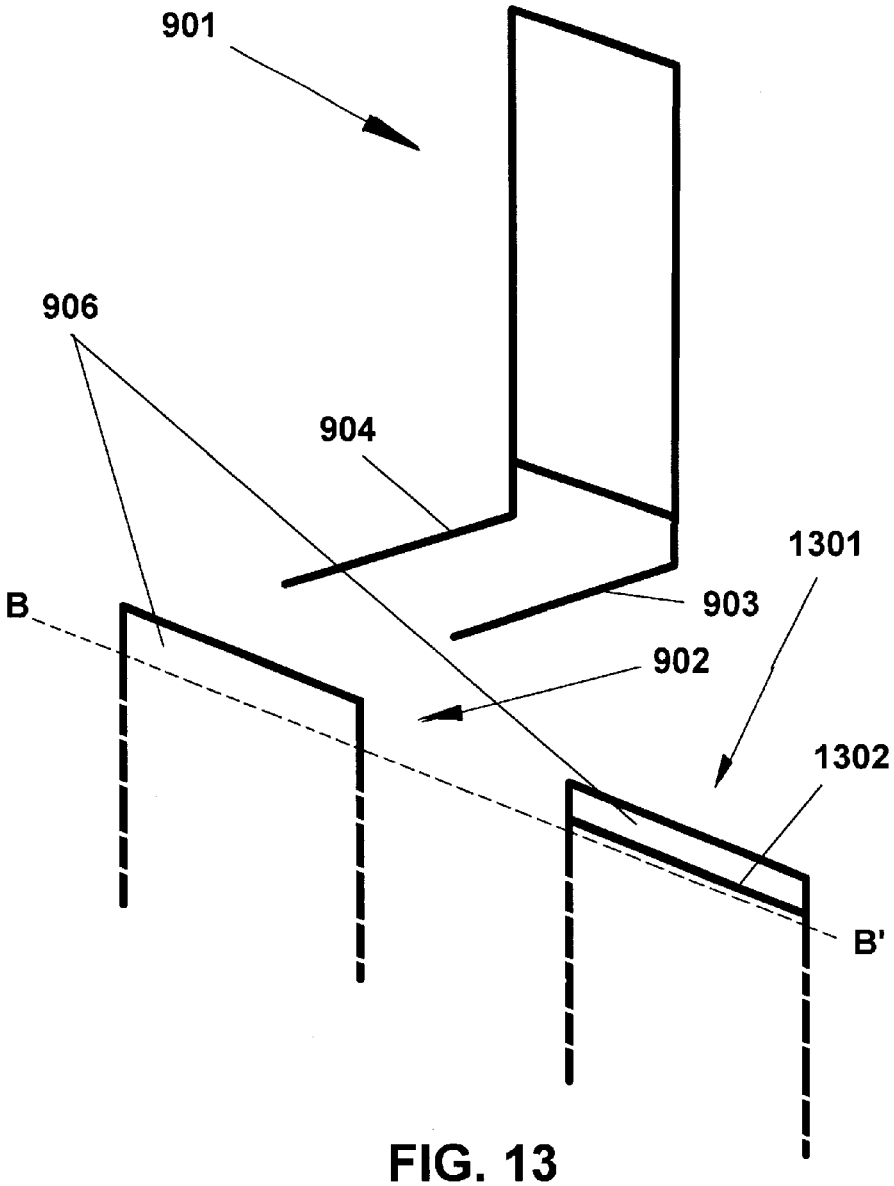
FIG. 13 is an exploded perspective view of the second embodiment of the present invention.

FIG. 13 is an exploded perspective view of the second embodiment more clearly showing the two separate parts of the present invention, upper fork part 901 and lower spike part 902. An optional alternative lower spike part 1301 may further comprise a stop bar 1302 parallel to cross piece 905, defining a space 906 between the stop bar 1302 and cross piece 905. The vertical width of the space 906 is such as to accommodate forks 903 and 904. The stop bar 1302 serves to prevent driving the optional lower spike part 1301 too far into the ground, as well as providing additional stiffness for the lower spike part 1301.

Figure 14:
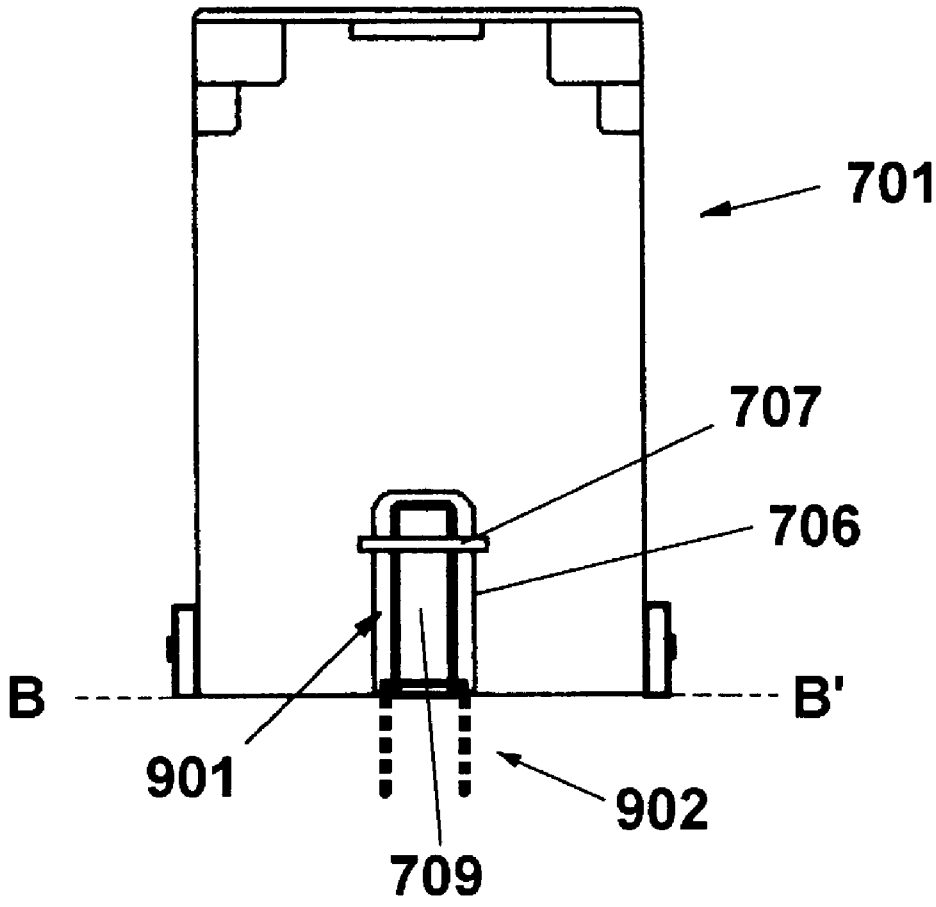
FIG. 14 is a front view of the second embodiment of the present invention with a roll-away trash receptacle installed on it.

FIG. 14 is a front view of the second embodiment of the present invention with a roll-away trash receptacle installed on it. Note that upper part 901 is located between recess 706 and retainer 707 on receptacle 701.

Figure 15:
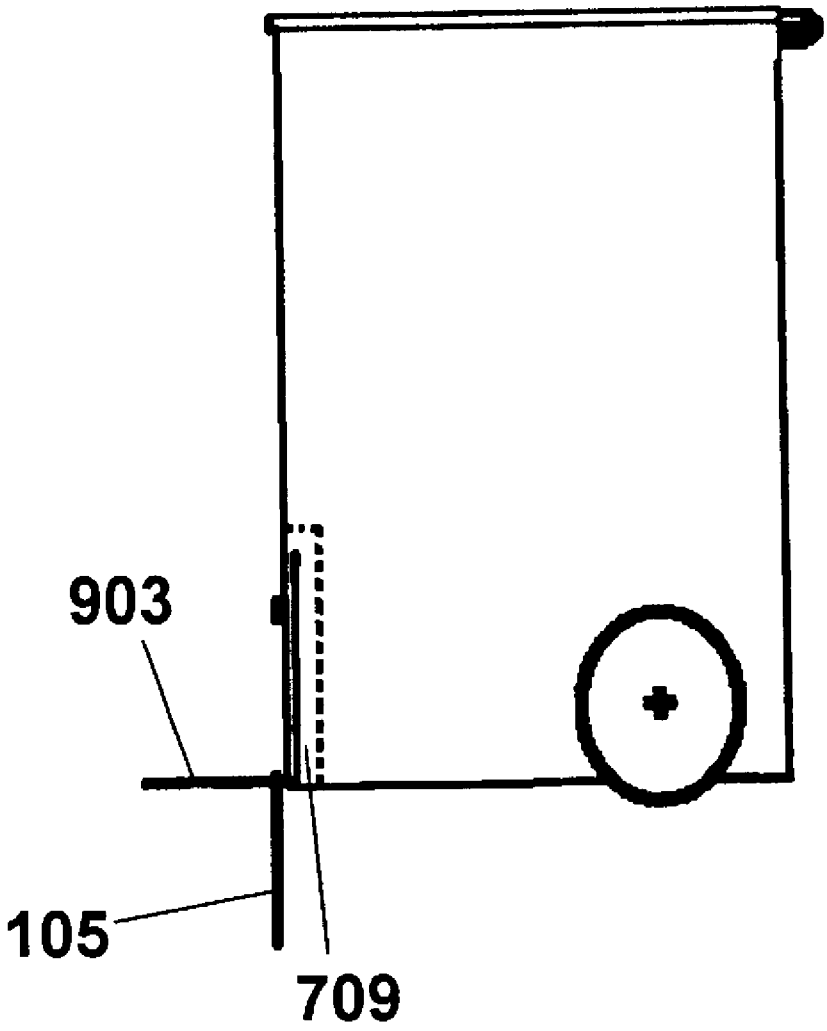
FIG. 15 is a side view of the second embodiment of the present invention with a roll-away trash receptacle installed on it.

FIG. 15 is a side view of the second embodiment of the present invention with a roll-away trash receptacle installed on it.

What is claimed is:

1. A support for a rigid receptacle having a downward-facing cavity, comprising:

an upper portion and a lower portion;

the upper portion having holding means for temporary engagement with the receptacle;

the upper portion comprising at least two rigid vertical rods connected by a first lateral rod forming a head;

the head on the upper portion shaped so as to engage the downward-facing cavity so that the weight of the receptacle retains the receptacle on the head;

the upper portion detachably engageable to the lower portion by cooperating means on each portion;

the lower portion having insertion means for temporary insertion into 6 the ground;

the insertion means comprising at least two spikes, each having a top end, an intermediate portion and a bottom end;

the top ends of said spikes being rigidly connected by a cross piece;

wherein said vertical rods on said upper portion each have a lower extremity;

said cooperating means comprises, on said upper portion, a fork rigidly attached to each lower extremity at right angles to each vertical rod and parallel to the ground, the forks having free ends, the free ends defining an overall fork width and an overall fork height;

said cooperating means comprises, on said lower portion, spacing between at least one pair of adjacent spikes at least equal to the overall fork width; and said cooperating means also comprises, on said lower portion, a slot bounded on either side by spacing between the adjacent spikes, on the top by said cross piece, and on the bottom by the ground when said lower portion is inserted into the ground a distance no less than the overall fork height, so that said upper portion and said lower portion can be joined together by sliding the forks into the slot.

2. The support of claim 1 wherein:

said intermediate portions of said spikes are further rigidly joined together by a stop bar parallel to, and below, said cross piece so that said slot is defined by said adjacent spikes, said cross piece and the stop bar.

3. The support of claim 1 wherein:

plural said lower portions are inserted into the ground and spaced apart so that said forks on said upper portion detachably engage all of the plural said slots.

4. In combination, a trash receptacle and a shaped support means comprising:

a rigid trash receptacle comprising an openable top and at least one downward-facing cavity, the plane of opening of the at least one cavity being substantially horizontal, on the outside of the receptacle;

a support means shaped to removably engage one of the at least one cavities on the receptacle when that cavity is placed over the support means so that horizontal motion of the receptacle is inhibited, and further shaped to temporarily and fixedly engage the ground;

a rigid rod permanently bent to form three sides of a rectangle, two of the sides being longer than the third side, the third side being shaped to fit into said cavity, each of the long sides having a first and second intermediate point equidistant from the short side and a first and second end point distal from the third side;

rigid cross piece affixed at its ends to each intermediate point; and the long sides being of a length such that when the support means is placed on the ground with the third side up and the cross piece is pressed downward into the ground until the cross piece comes into contact with the ground, the third side fits into said cavity.

5. The combination of claim 4 in which said shaped support means further comprises an upper portion and at least one lower portion, the upper portion comprising:

a) two rigid L-shaped rods each having a long side and a short side at right angles, the long sides each having an intermediate point and a top end, and the short sides each having a front end, the top ends rigidly joined together by a top piece so that the long sides arc parallel to each other and perpendicular to the top piece, the short sides being perpendicular to the plane formed by the long sides;

b) the top piece being shape to fit into said cavity; and c) a rigid stiffener equal in length to the top piece being affixed to the intermediate points on the long sides; and at least one lower portion comprising:

a rigid rod permanently bent to form three sides of a rectangle, two of the sides being spikes, the third side being sized so that the short sides of the L-shaped pieces fit slidingly between the spikes; and the long sides of the upper portion being of a length such that when a lower portion of the support means is placed on the ground with the third side up and the third side is pressed downward into the ground until the cross piece is above the ground by a distance such that the short sides of the upper portion fit slidingly between the cross piece and the ground, and the upper portion is engaged to the lower portion by sliding the short sides between the cross piece and the ground, the shaped top piece of the upper portion fits into said cavity on said receptacle when said cavity is lowered over the shaped top piece.

6. The combination of claim 4 which said shaped support means further comprises an upper and at least one lower portion, the upper portion comprising:

a) two rigid L-shaped rods each having a long side and a short side at right angles, the long sides each having an intermediate point and a top end, and the short sides each having a front end, the top ends rigidly joined together by a top piece so that the long sides are parallel to each other and perpendicular to the top piece, the short sides being perpendicular to the plane formed by the long sides;

b) the top piece being shaped to fit into the cavity; and c) a rigid stiffener equal in length to the top piece being affixed to the intermediate points on the long sides; and at least one lower portion comprising:

a rigid rod permanently bent to form three sides of a rectangle, two of the sides being spikes, the spikes each having an intermediate point, a stop bar being affixed between the intermediate points parallel to the third side;

the spikes, the third side, and the stop defining a slot;

the slot being of a length and width to slidingly accommodate both front ends of the upper portion; and the long sides of the upper portion being of a length such that when a lower portion of the support means is placed on the ground with the third side up, and the third side is pressed downward into the ground until the stop bar contacts the ground, and the upper portion is engaged to the lower portion by sliding the short sides of the upper portion into the slot, the shaped top piece of the upper portion fits into said cavity on said receptacle when said cavity is lowered over the shaped top piece.

* * * * *